US005217394A

United States Patent [19]

Ho

[11] Patent Number: 5,217,394

[45] Date of Patent: Jun. 8, 1993

[54] CONVERTER-TYPE CIRCUIT CONNECTOR FOR LINKING ELECTRONIC DEVICES

[76] Inventor: Ming-Chiao Ho, 8F-1, 45 Fu-Shin Road, Hsin-Tien, Taipei, Taiwan

[21] Appl. No.: 942,860

[22] Filed: Sep. 10, 1992

[51] Int. Cl.[5] ..... H01R 13/00

[52] U.S. Cl. ..... 439/620; 439/638

[58] Field of Search ..... 439/74, 76, 620, 638

[56] References Cited

U.S. PATENT DOCUMENTS

| | | | |
|---|---|---|---|
| 5,026,293 | 6/1991 | Wilson | 439/620 |
| 5,101,322 | 3/1992 | Ghaem et al. | 439/620 |
| 5,115,368 | 5/1992 | Smith | 439/620 |
| 5,117,122 | 5/1992 | Hogarth et al. | 439/620 |

*Primary Examiner*—Joseph H. McGlynn
*Attorney, Agent, or Firm*—Jacobson, Price, Holman & Stern

[57] ABSTRACT

A converter-type circuit connector for linking electronic devices. Preferably, the converter-type connector comprises a D-type 50-point contact connector, a converter circuit board having an upper and lower circuit boards, two D-type 25-point contact connectors, upper and lower covers, and an iron panel, the D-type 50-point contact connector having a male configuration and both lateral sides thereof being indented with grooves for fastening the connector to an electronic device. Inside the converter-type connector, two rows of electrical conductors exit the back of the D-type 50-point contact connector. Each electrical conductor is angled at 90 degrees and connects with the converter circuit board. The 50-point contact connector defines the front of the converter-type circuit connector, the housing of which is defined by the upper and lower covers. The contacts of the 50 point contact connector are electrically connected, through the electrical conductors and the converter circuit board, to the pair of D-type 25-point contact connectors. The pair of 25-point contact connectors are affixed to the iron panel at an opposite side of the converter-type circuit connector from the 50 point contact connector. The iron panel thus defines the back of the converter-type circuit connector. One D-type 25-point contact connector is connected to a second set of electrical conductors, also angled at 90 degrees and directly welded and affixed to the lower circuit board. The other D-type 25-point contact connector is connected to the lower circuit board by way of a ribbon cable.

16 Claims, 3 Drawing Sheets

CONVERTER-TYPE CIRCUIT CONNECTOR FOR LINKING ELECTRONIC DEVICES

BACKGROUND OF THE INVENTION

The present invention relates to a converter-type electronic circuit connector applicable to transferrable communication links between a computer and its peripheral equipment.

Presently, for communicating with external storage devices such as hard disk drives, tape drives, CD ROM drives, etc., there are two types of controllers for external links in a computer system.

(1) According to a first type, the controller circuit of a particular drive is installed within the computer system with an additional connection and cable providing a link to the drive itself.

(2) According to the second type, the additional storage device control circuit board is instead affixed to the connection for the expansion slots inside the computer system. When it is desired to install an additional one, the operator must open the housing of the computer to add the addition circuit board.

For the above two conventional types, because the hardware jumper configuration in the computer is different from that in the peripheral equipment's storage device, the user must always adjust the jumper configuration of the hardware when the computer is installed or its peripheral equipment is altered. This is a task that is not easily borne the average computer user. Furthermore, it is troublesome for the user to dismantle the computer's housing for insertion of an interface card. In fact, present notebook type computer structures do not permit their housings to be dismantled in order to expand performance. In this regard, the two convention types mentioned above are less than perfect.

In light of the aforementioned defects, engineers in the industry have designed an electronic circuit converter for connecting one or more channels of a storage device through conversion to the standard output port of the computer. FIG. 1 illustrates one such circuit converter A having a connector A1 in one port for input or output and a pair of connectors A2, A3 in the two or more other ports for input and output purposes. The converter A uses many sets of cables with connectors at both ends thereof. One such cable is illustrated in FIG. 2. By varying the connector types in the cable B, the computer C, printer D, several types of storage devices E and F and other peripheral equipment are quickly and easily interconnected. In particular, the connections are made between each machine through the circuit converter A using the cables B. By using such a configuration, there is no need to dismantle the housing of the computer. Despite solving most of the defects or problems associated with an external connection of the computer to a storage device, circuit converters such as the one illustrated in FIG. 1 and other mechanical equipment are dependent upon the cable's connection. In addition, the following defects inherently exists due to the structure of the circuit converter A:

(1) A cable is required having a conversion head between the circuit converter A and the computer's storage device. Accordingly, the user would have to bear the cost of such a cable. In addition, the circuit converter A cannot be plugged directly into the housing of the storage device. Instead, it must be placed together with the dangling extension line on the desk of a user. Besides taking up space on the user's desk, this usually results in a disorderly arrangement. Furthermore, the core wire in the cable is usually twisted in strands. Such twisting of wire not only creates an unstable change in line capacitance, but also it produces signal interference. Making a circuit to compensate for this signal interference is usually too difficult. The accuracy of the data stored via a circuit converter A is therefore frequently suspected and doubted. In addition, there are many electrical contact points and a long transmission distance which adversely affect the efficiency of signal transmission.

(2) Inside the converter A, there is a single way converter circuit board using an iron panel to fix the connection of the circuit board with the wire. This kind of structure is limited since the physical area of the single way circuit board is limited. As a result, the design of circuit's functionality is restricted. In addition, although there is ample space within the converter, such space is not being fully utilized and is therefore being wasted.

SUMMARY OF THE INVENTION

It is a primary object of the present invention to overcome the aforementioned defects by providing a converter-type connector which occupies a minimal amount of desk-top space, while at the same time providing excellent converter performance, transmission, and operations.

It is a further object of the present invention to provide a converter-type connector having a D-type 50 point contact connector with a fastening mechanism at its front end; a double deck converter circuit board located within the converter-type connector; and two D-type 25 point contact connectors.

Preferably, the converter-type connector comprises a D-type 50-point contact connector, a converter circuit board having an upper circuit board and a lower circuit board, two D-type 25-point contact connectors, upper and a lower covers, and an iron panel. In addition, the D-type 50-point contact connector has a male configuration and both lateral sides thereof are indented with grooves for fastening the connector to an electronic device.

Inside the converter-type connector, two rows of electrical conductors exit the back of the D-type 50-point contact connector. Each electrical conductor is angled at 90 degrees as it exits the back of the 50-point connector and connects with the converter circuit board. The 50-point contact connector defines the front of the converter-type circuit connector, the housing of which is defined by the upper and lower covers. The contacts of the 50 point contact connector are electrically connected, through the electrical conductors and the converter circuit board, to the pair of D-type 25-point contact connectors. The pair of 25-point contact connectors are affixed to the iron panel at an opposite side of the converter-type circuit connector from the 50 point contact connector. The iron panel thus defines the back of the converter-type circuit connector.

The two D-type 25-point contact connectors are connected in the following manner: One D-type 25-point contact connector is connected to a second set of electrical conductors, also angled at 90 degrees and directly welded and affixed to the lower electronic circuit board of the converter circuit board. The other D-type 25-point contact connector is connected to the lower circuit board by way of a ribbon cable.

On the surfaces of both circuit boards, there are board to board male/female interconnectors to link the signals between the upper and lower circuit boards, each circuit board being designed to exactly fill the space between the 50-point contact connector and the two 25-point contact connectors.

The 50-point contact connector, which has a male configuration, may be inserted directly into the housing of any storage device having a corresponding female connection. Using the converter-type connector in this manner eliminates the need for a connecting cable which would otherwise be required. Accordingly, the desired effect of lessening contact points and transmission distance and avoiding the change in electrical capacitance and signal interference between the lines, is achieved, as well as upgrading of the signal transmission efficiency.

Further, the available board real estate of the converter circuit board increases due to the fact that the board within the converter-type connector comprises an upper and a lower circuit board. This "double deck" arrangement alone significantly enhances the functions of the converter-type connector.

The above and other objects and advantages will become more readily apparent when reference is made to the following description taken in conjunction with the accompanying drawings.

DETAILED DESCRIPTION OF A PREFERRED EMBODIMENT

Figure 1:
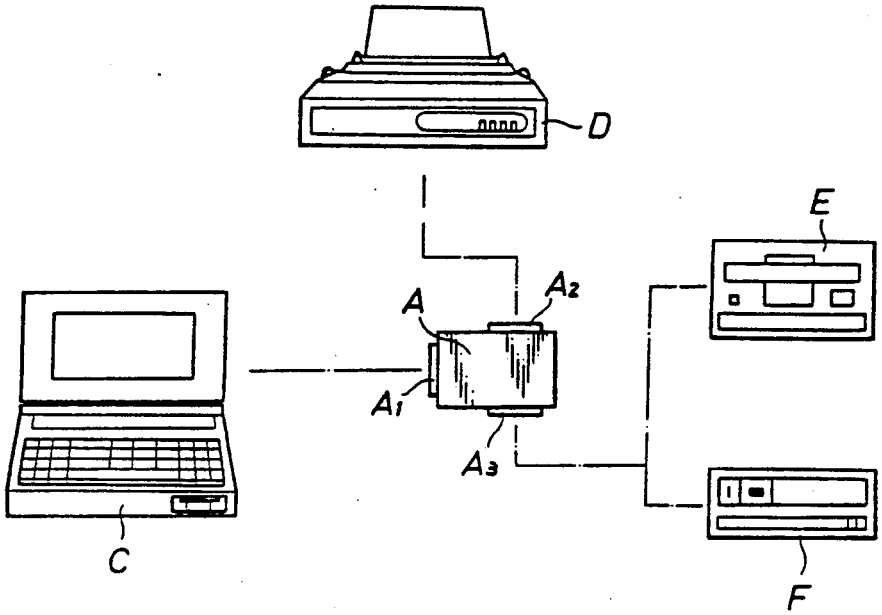
FIG. 1 illustrates a conventional circuit converter for use with a computer system having peripheral devices.
Figure 2:
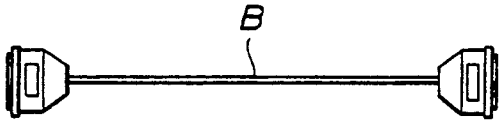
FIG. 2 illustrates a conventional cable used to link the devices illustrated in FIG. 1.
Figure 4:
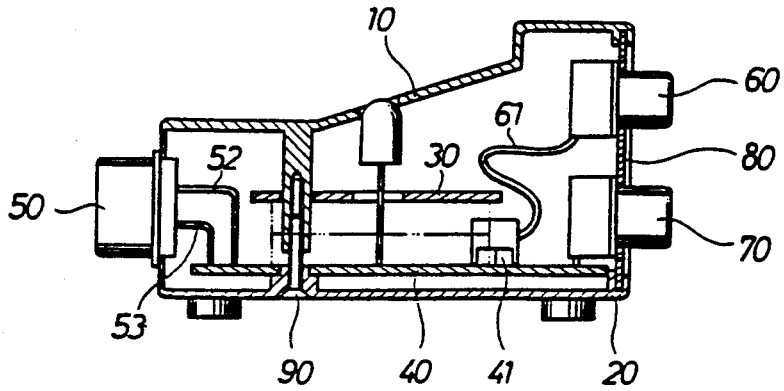
FIG. 4 is a cross section of the preferred embodiment illustrated in FIG. 3.
Figure 3:
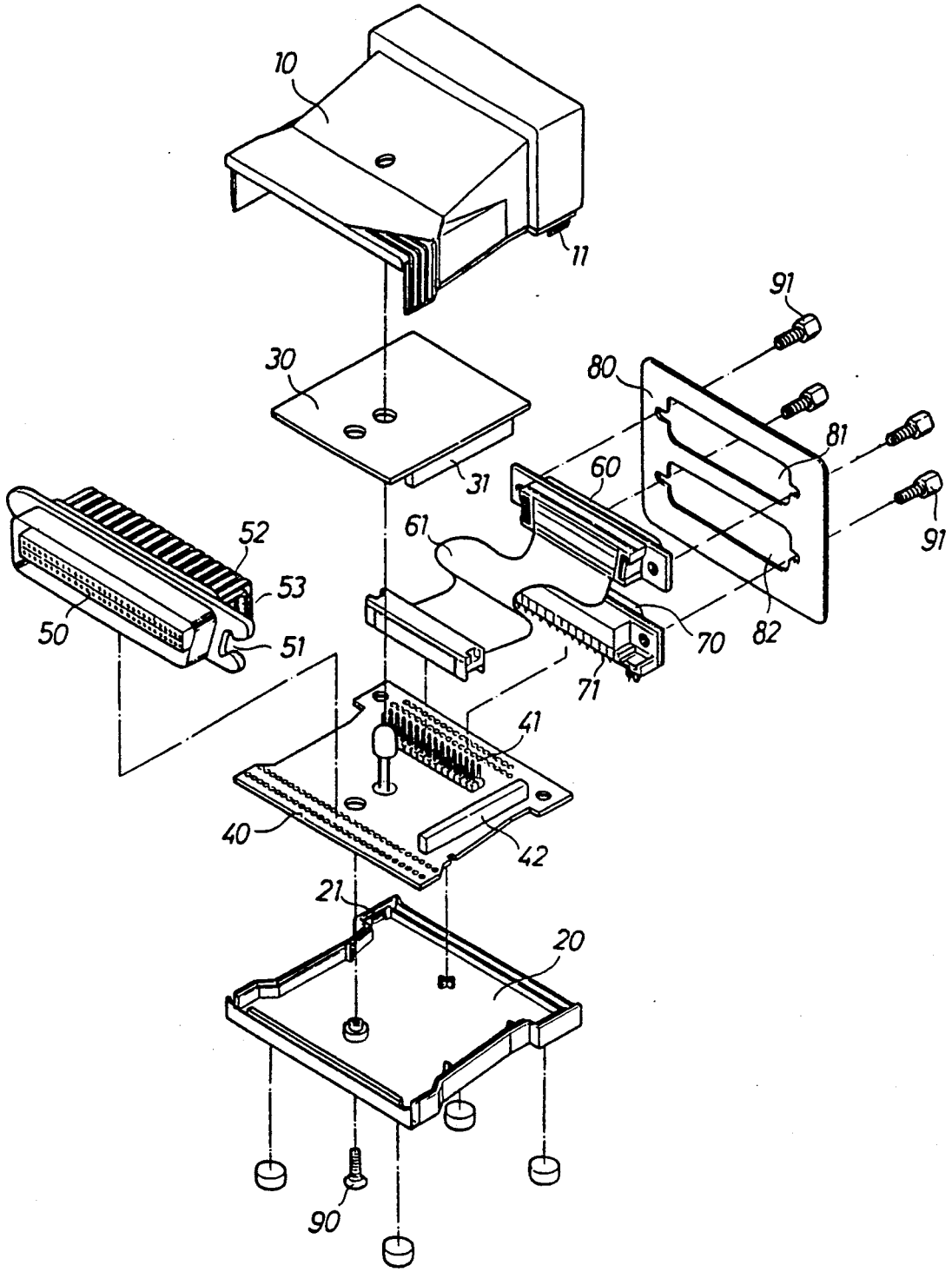
FIG. 3 is an exploded view of a preferred embodiment of the converter-type circuit connector of the present invention.
Figure 5:
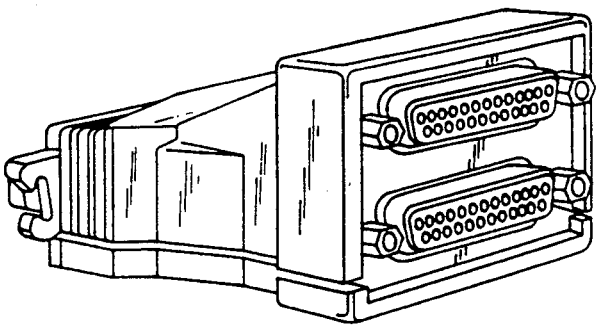
FIG. 5 is an elevation of the preferred embodiment illustrated in FIGS. 3 and 4

With reference to FIGS. 3 through 5, a preferred embodiment of a converter-type circuit connector will now be described.

Specifically, the converter-type connector comprises an upper cover 10; a lower cover 20; a converter circuit board contained between the upper and lower covers 10 and 20, the converter circuit board comprising upper and lower circuit boards 30 and 40; a D-type 50-point contact connector 50 having two rows 52 and 53 of conductors extending therefrom and angled at 90 degrees; two D-type 25-point contact connectors 60 and 70; and an iron panel 80 to which the two 25-point contact connectors 60 and 70 are attached. The iron panel and 25-point connectors define the back of the converter-type connector, while the 50-point connector defines the front.

The upper and lower covers 10 and 20 constitute the main body (or housing) of the converter-type connector. Preferably, the two covers 10 and 20 are joined using a flat-headed screw 90 located toward the front of the converter, which screw 90 passes through the lower cover 20 and is threadedly received by the upper cover 10. In addition, a pair of clamping hooks 11 (one hook not shown) is provided toward the rear of the converter-type connector on the upper cover 10, for engaging a pair of clamping grooves 21 (one groove not shown) formed inside the lower cover 20. Locked in place by the lower cover 20, is the lower circuit board 40.

The D-type 50-point contact connector 50 has a male configuration and fastening grooves on both lateral sides 51 thereof. Exiting the rear of the 50-point contact connector are the two rows 52 and 53 of electrical conductors. Each row 52 and 53 is directly welded and thereby attached to the lower circuit board 40. Installed in the rear end of the main body of the converter-type connector is the iron panel 80 which has two rounded rectangular holes 81 and 82 for receiving the head ends of the upper and lower D-type 25-point connectors 60 and 70. Once received in the holes 81 and 82, the 25-point connectors are locked in place using a four bolts 91, each bolt passing through the iron panel 80 and being received by a lateral side of the 25-point contact connectors. The upper D-type 25-point connector 60 is received and electrically connected to a ribbon cable 61 which is, in turn, connected to a pin header 41 on the lower circuit board 40. In this manner, the pin header 41 of the lower circuit board is electrically connected to the upper 25-point contact connector. The lower D-type 25-point contact connector 70, on the other hand, has a set of conductors 71 projecting downwardly from the connector 70. These conductors are directly welded and thereby attached to the lower circuit board 40.

The lower circuit board 40 is further equipped with a board-to-board female interconnector 42 designed to engage a male board-to-board interconnector 31 located on the upper circuit board 30. These interconnectors 31 and 42 allow the upper circuit board 30 to communicate with the lower circuit board 40. Accordingly, a converter circuit board is defined having a double deck configuration.

By using the foregoing structure plus a cable to connect one of the 25-point contact connectors 60 or 70 to a computer, the computer can be linked to a standard storage device. In doing so, the D-type 50-point contact connector is linked to the storage device such as hard drive, tape drive, CD ROM drive etc. This way, the signals transmitted between the standard storage device and the computer, pass through the converter circuit board of the present invention.

According to the present invention, there are three connections available for interconnecting the computer, printer and storage devices. The preferred usage of the present invention finds the front end (the D-type 50-point contact connector 50) directly inserted and fastened within the housing of a storage device, thereby uniting the main body of the present invention with the housing of the storage device. The converter-type connector of the present invention is thus supported by the housing of the storage device.

With regard to disconnecting the present invention, when the main body of the converter-type connector is to be removed from the female D-type connector of the storage device, the removing force is spread evenly across the electrical circuit and the upper and lower covers 10 and 20 by the two rows of angled conductors 52 and 53 which are welded to the lower circuit board 40. Likewise, the hanging weight of the cable connected to and suspended behind the 25-point contact connectors, is spread across the main body of the converter-type connector by way of the iron panel 80. The structure of the present invention is therefore firm and durable.

Although the preferred embodiment uses a pair of 25-point contact connectors, it is understood that the number of points can be varied according to the specific needs of a user. In this regard, the present invention is not limited to D-type 25-point contact connectors at the rear of the converter-type connector. The number of points can be varied, for example, by changing the dimensions of the holes 81 and 82 in the iron panel 80 to conform with the dimensions of a D-type 14 to 36-point contact connector.

The following advantages, among others, are realized by using the present invention:

(1) The front end of the converter-type connector mates 10 directly with a female connection on the storage device's housing. Accordingly, use of one set of round cables between the converter-type connector and the storage device, which set of cable is otherwise required by conventional converters, is altogether avoided by the present invention. This is especially important since this link in a computer network is very sensitive to signal interference. The user is thus also saved the cost of purchasing such a cable. In addition, the distance the signal is transmitted shortens and the number of contact points is lessened. As a result, the possibility of poor contact is greatly reduced which can further avoid interference between noisy signals in different lines. This substantially improves the efficiency of the signal transmission.

(2) The space within the main body by the converter-type connector is fully utilized by the converter circuit board which comprises the upper and lower circuit boards in a double deck arrangement. Because of this arrangement, there is an increase in the amount of usable space on the converter circuit board, thereby allowing the functions of the circuit converter to increase.

(3) Once the present invention engages the housing of a storage device, the present invention remains attached to and supported by the storage device in a hanging manner. There is no need to place the conventional converter on a table or desk. Therefore, no table space is occupied. In this regard, the converter-type converter is handy to use.

(4) The D-type connector at the front end of the present invention has 50 contact points, while the corresponding number of fastening and clamping bodies in the female groove of the corresponding storage device can contain 50 or less than 50 contact points. The applicability of the present invention is therefore wide and diverse. In other words, after the present invention is introduced into the market, it may promote the design of corresponding female groove fastening and connection bodies with 50 contact points.

I claim:

1. A converter-type circuit connector for linking electronic devices, said converter-type circuit connector comprising:

housing means having a front end and back end;

converter circuit board for converting signals from said electronic devices, said converter circuit board being contained within said housing means and comprising an upper circuit board and a lower circuit board substantially parallel to upper circuit board;

D-type 50-point contact connector defining the front end of said housing means, for physically and electrically connecting the converter-type connector to one of said electronic devices, said D-type 50-point contact connector being electrically connected to the converter circuit board by way of a set of electrical conductors which exit the D-type 50-point contact connector and are received by said converter circuit board in a substantially perpendicular manner;

panel means defining the back end of said housing means, said panel means having at least two openings;

first D-type 25-point contact connector mounted in one of said at least two openings and electrically connected to the converter circuit board by a second set of conductors, said second set of conductors exiting the first D-type 25-point contact connector so as to intersect said converter circuit board in a substantially perpendicular manner; and second D-type 25-point contact connector mounted in another one of said at least two openings and electrically connected to the converter circuit board by a ribbon cable.

2. The converter-type circuit connector of claim 1, wherein said panel means comprises a substantially flat iron panel.

3. The converter-type circuit connector of claim 1, further comprising male and female board-to-board connectors for electrically interconnecting said upper and lower circuit boards.

4. The converter-type circuit connector of claim 1, wherein said D-type 50-point contact connector is constructed in a male configuration and comprises a pair of laterally disposed grooves for engaging a corresponding female socket in one of said electronic devices, whereby the converter-type circuit connector is physically supported by the female socket.

5. The converter-type circuit connector of claim 1, wherein said set of electrical conductors exiting the D-type 50-point contact connector is arranged to form two rows of conductors, each of said conductors being downwardly bent to form right angles and welded to the lower circuit board such that during insertion or removal of the D-type 50-point contact connector from one of said electronic devices, any force applied is distributed across the converter circuit board to the housing means.

6. The converter-type circuit connector of claim 1, wherein said housing means comprises an upper cover and a lower cover.

7. The converter-type circuit connector of claim 6, wherein said upper cover further comprises at least one clamping hook and said lower cover comprises at least one clamping groove; said at least one clamping hook engaging said at least one clamping groove to securely join said upper and lower covers.

8. The converter-type circuit connector of claim 7, further comprising a screw passing through an opening in said lower cover and threadedly engaging said upper cover to securely join said upper and lower covers.

9. A converter-type circuit connector for linking electronic devices, said converter-type circuit connector comprising:

housing means having a front end and back end;

converter circuit board for converting signals from said electronic devices, said converter circuit board being contained within said housing means and comprising an upper circuit board and a lower circuit board substantially parallel to upper circuit board;

D-type 50-point contact connector defining the front end of said housing means, for physically and electrically connecting the converter-type connector to one of said electronic devices, said D-type 50-point contact connector being electrically connected to the converter circuit board by way of a set of electrical conductors which exit the D-type 50-point contact connector and are received by said converter circuit board in a substantially perpendicular manner;

panel means defining the back end of said housing means, said panel means having at least two openings;

first D-type contact connector having 14 to 36 contact points, said first D-type contact connector being mounted in one of said at least two openings and electrically connected to the converter circuit board by a second set of conductors, said second set of conductors exiting the first D-type contact connector so as to intersect said converter circuit board in a substantially perpendicular manner; and second D-type contact connector having 14 to 36 contact points, said second D-type contact connector being mounted in another one of said at least two openings and electrically connected to the converter circuit board by a ribbon cable.

10. The converter-type circuit connector of claim 9, wherein said panel means comprises a substantially flat iron panel.

11. The converter-type circuit connector of claim 9, further comprising male and female board-to-board connectors for electrically interconnecting said upper and lower circuit boards.

12. The converter-type circuit connector of claim 9, wherein said D-type 50-point contact connector is constructed in a male configuration and comprises a pair of laterally disposed grooves for engaging a corresponding female socket in one of said electronic devices, whereby the converter-type circuit connector is physically supported by the female socket.

13. The converter-type circuit connector of claim 9, wherein said set of electrical conductors exiting the D-type 50-point contact connector is arranged to form two rows of conductors, each of said conductors being downwardly bent to form right angles and welded to the lower circuit board such that during insertion or removal of the D-type 50-point contact connector from one of said electronic devices, any force applied is distributed across the converter circuit board to the housing means.

14. The converter-type circuit connector of claim 9, wherein said housing means comprises an upper cover and a lower cover.

15. The converter-type circuit connector of claim 14, wherein said upper cover further comprises at least one clamping hook and said lower cover comprises at least one clamping groove; said at least one clamping hook engaging said at least one clamping groove to securely join said upper and lower covers.

16. The converter-type circuit connector of claim 15, further comprising a screw passing through an opening in said lower cover and threadedly engaging said upper cover to securely join said upper and lower covers.

* * * * *